US008256577B2

(12) United States Patent
Kritzer

(10) Patent No.: US 8,256,577 B2
(45) Date of Patent: Sep. 4, 2012

(54) PORTABLE TWO POST AUTOMOBILE LIFT

(75) Inventor: Jeffrey Scott Kritzer, Moorpark, CA (US)

(73) Assignee: Dannmar Worldwide, Inc., Moorpark, CA (US)

( * ) Notice: Subject to any disclaimer, the term of this patent is extended or adjusted under 35 U.S.C. 154(b) by 740 days.

(21) Appl. No.: 12/263,066

(22) Filed: Oct. 31, 2008

(65) Prior Publication Data

US 2010/0108445 A1 May 6, 2010

(51) Int. Cl.
*B66F 7/00* (2006.01)

(52) U.S. Cl. ..... 187/215; 187/218

(58) Field of Classification Search ..... 187/215, 187/218, 213

See application file for complete search history.

(56) References Cited

U.S. PATENT DOCUMENTS

| | | | | | |
|---|---|---|---|---|---|
| 2,099,636 | A | | 11/1937 | Weaver | |
| 2,867,409 | A | | 1/1959 | Southerwick | |
| 2,915,143 | A | | 12/1959 | Simmons, Sr. | |
| 3,271,006 | A | | 9/1966 | Brown et al. | |
| 3,405,781 | A | * | 10/1968 | Brown | 187/219 |
| 4,599,034 | A | * | 7/1986 | Kennedy et al. | 414/678 |
| 4,825,977 | A | * | 5/1989 | Isogai | 187/206 |
| 5,009,287 | A | * | 4/1991 | Starr | 187/213 |
| 5,236,065 | A | | 8/1993 | Isogai | |
| 5,318,154 | A | * | 6/1994 | Hellman et al. | 187/203 |
| 5,358,217 | A | | 10/1994 | Dach | |
| 5,411,234 | A | * | 5/1995 | Schoeller | 248/345.1 |
| 5,484,134 | A | * | 1/1996 | Francis | 254/2 B |
| 5,911,408 | A | * | 6/1999 | Berends et al. | 254/2 B |
| 5,954,160 | A | * | 9/1999 | Wells et al. | 187/219 |
| 6,273,215 | B1 | | 8/2001 | Horan et al. | |
| 6,279,685 | B1 | * | 8/2001 | Kogan et al. | 187/208 |
| 6,505,815 | B1 | * | 1/2003 | Dellamore | 254/2 B |
| 6,845,848 | B1 | * | 1/2005 | Kritzer | 187/221 |
| 7,014,012 | B2 | * | 3/2006 | Baker | 187/247 |
| 2003/0121726 | A1 | * | 7/2003 | Berends | 187/209 |
| 2005/0067227 | A1 | | 3/2005 | Wengelski et al. | |

FOREIGN PATENT DOCUMENTS

| | | |
|---|---|---|
| CA | 564118 | 9/1958 |

* cited by examiner

*Primary Examiner* — Michael Mansen
*Assistant Examiner* — Michael Riegelman
(74) *Attorney, Agent, or Firm* — Erickson, Kernell, Derusseau & Kleypas, LLC

(57) ABSTRACT

A portable automobile lift includes a plurality of portable lifting columns and a portable power unit. Each lifting column includes a column base, a post extending upwardly from the column base, a lifting carriage moveably mounted on a forward side of the post, and a hydraulic actuator connected to the lifting carriage for movement of the lifting carriage along the post. Each column base comprises a respective base plate connected to a lower end of the respective post. The base plate anchor bolt receiving holes extending therethrough for receiving respective anchor bolts. Each column base further includes a pair of wheels positioned to engage a ground surface rearward of the base plate. The lift also includes a portable power unit for providing hydraulic fluid to the actuators. The power unit is mounted on a cart for easy transportation and storage.

28 Claims, 5 Drawing Sheets

PORTABLE TWO POST AUTOMOBILE LIFT

BACKGROUND OF THE INVENTION

1. Field of the Invention

This invention relates to automobile service lifts, and in particular to a two post lift having portable lifting columns which can be easily moved into position and bolted down for use and then unbolted and removed for storage.

2. Description of the Related Art

A wide variety of post-type automobile lifts have been previously known and used in the automobile repair business and by hobbyists to provide access to the underside of a vehicle. Post lifts can be either of the in-ground or above-ground variety. In-ground post lifts usually have one or two vertically ascending columns mounted below the floor of a garage or service area which are raised hydraulically to lift the vehicle. Above-ground post lifts generally have two or four vertical columns or "posts," each of which includes a carriage which rides up and down the post. The carriages each include outwardly extending outriggers or arms which engage the undercarriage of a vehicle to be lifted. Traditionally, these posts have been permanently installed in a fixed position.

Portable above-ground post lifts are also known in the prior art. These prior art lifts include portable lifting columns having wheels for moving them from place to place. In order to stabilize the lifting columns while in use, the lifting columns generally include large bases having forwardly extending legs. These legs serve to keep the columns from tipping forwardly when a load is applied to the arms. While the legs are effective in preventing tipping of the lifting columns, they make the lifting columns more difficult to transport and substantially increase the amount of space needed to store them when not in use. It would, therefore, be desirable to produce a portable lift having a smaller base to facilitate easy transport and storage of the lifting columns.

SUMMARY OF THE INVENTION

The present invention is a portable two-post lift having column bases that do not include outwardly extending legs. Instead, the bases each comprise a base plate connected to a lower end of the post. Each base plate has one or more edges which are spaced outwardly from the respective walls of the post to form mounting flanges. The mounting flanges have anchor bolt receiving holes extending therethrough, allowing the lifting columns to be temporarily bolted to a slab when in use. The column bases each further include a pair of wheels positioned to engage a ground surface rearward of the base plate.

When the lift is in use, anchor bolts are inserted through the anchor bolt receiving holes and tightened into anchors permanently installed in a concrete slab. When the lift is not in use, the anchor bolts may be removed to disconnect the column bases from the slab. The columns may then be tilted back onto their wheels and rolled to a storage location. Because the base plates are relatively small, the amount of storage space required for the lift is substantially less than for a comparable lift with outwardly extending legs.

The lift further includes a portable power unit for powering the lifting columns. The power unit includes a hydraulic pump, motor, and reservoir mounted on a cart for easy transport and storage. A rotary gear flow divider is also mounted on the cart and divides flow of hydraulic fluid between the lifting columns.

DETAILED DESCRIPTION OF THE PREFERRED EMBODIMENTS

Figure 1:
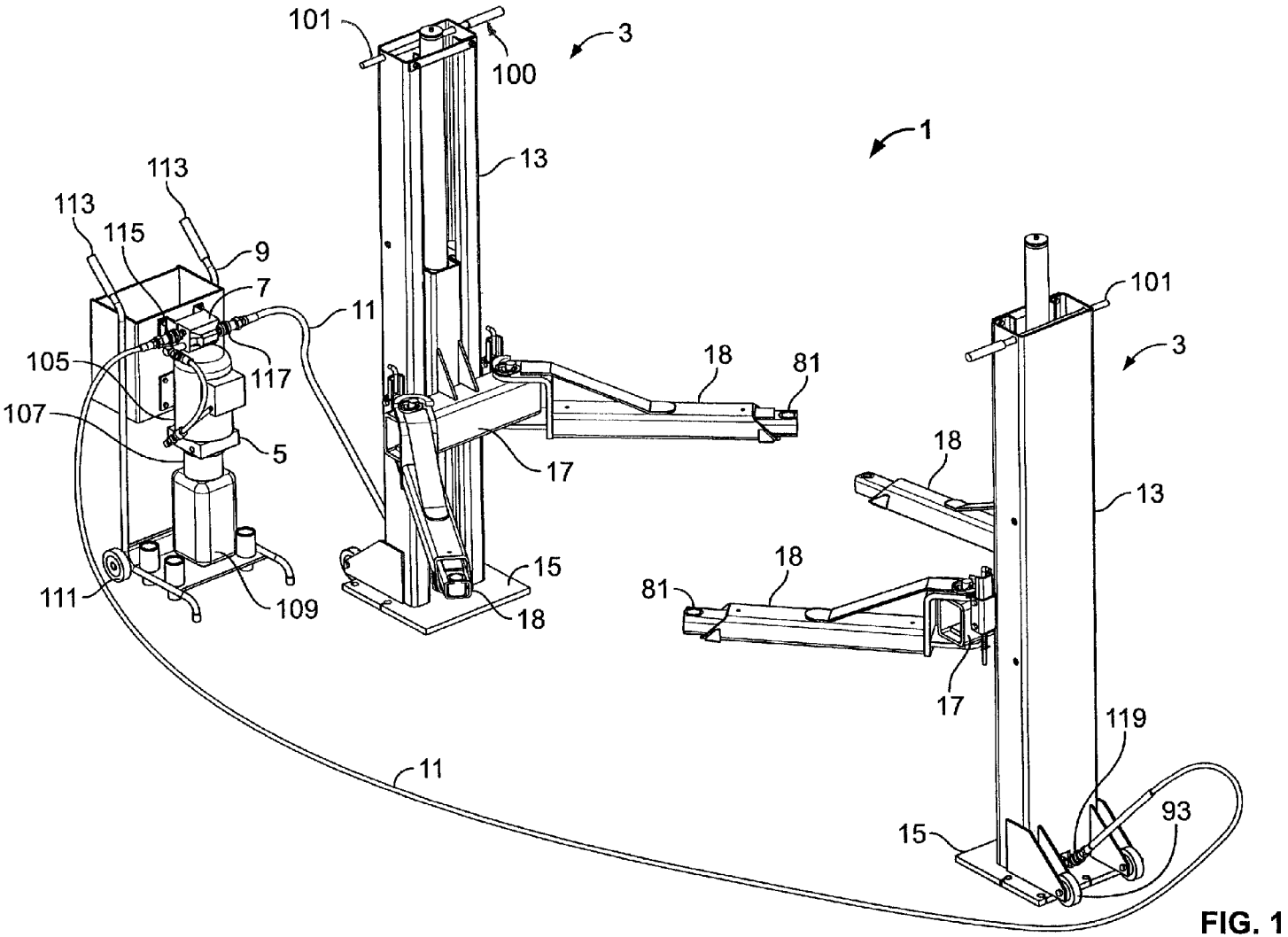
FIG. 1 is a perspective view of a portable two post automobile lift according to the present invention.
Figure 2:
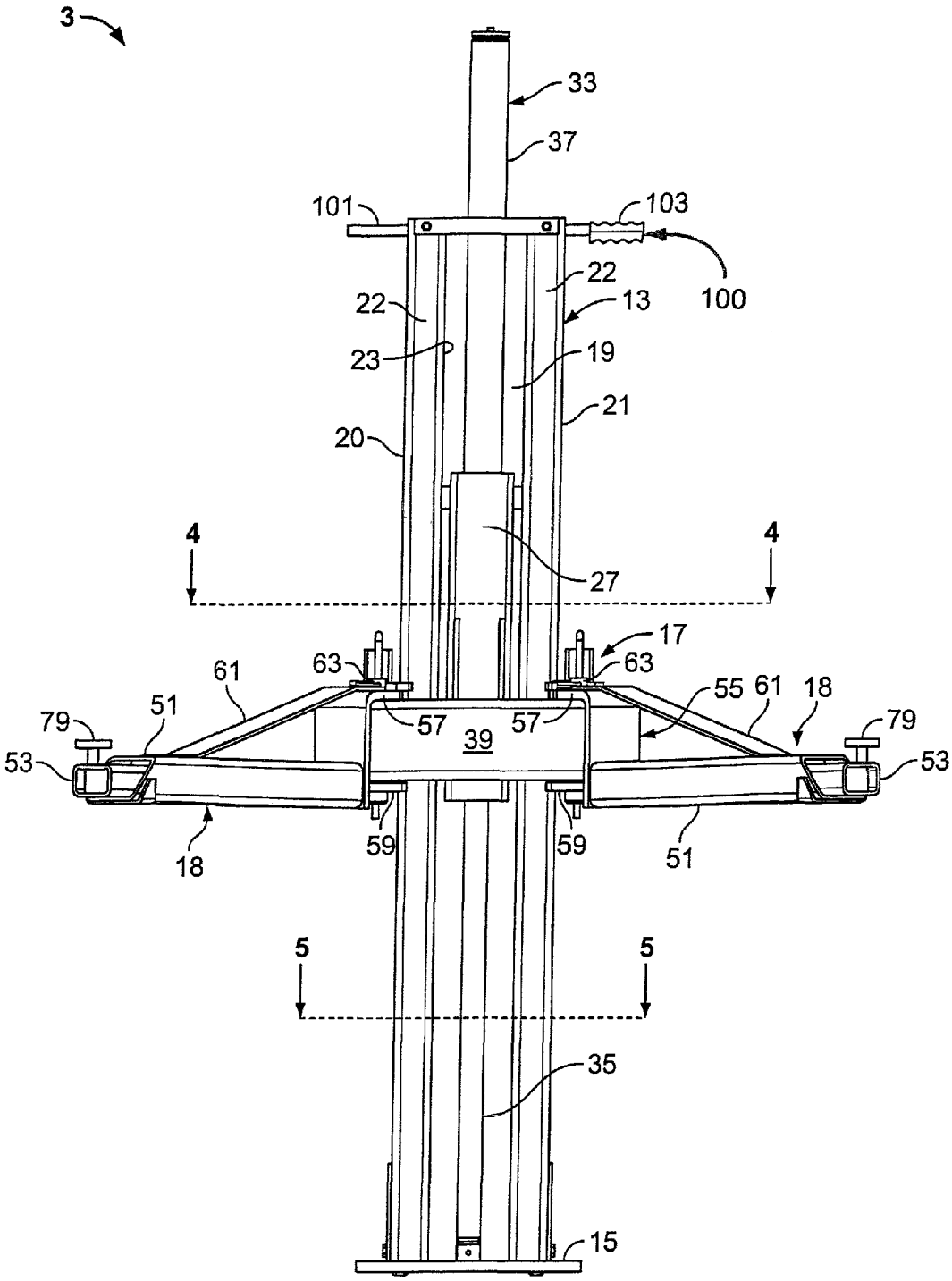
FIG. 2 is a front elevational view of one lifting column of the automobile lift.
Figure 3:
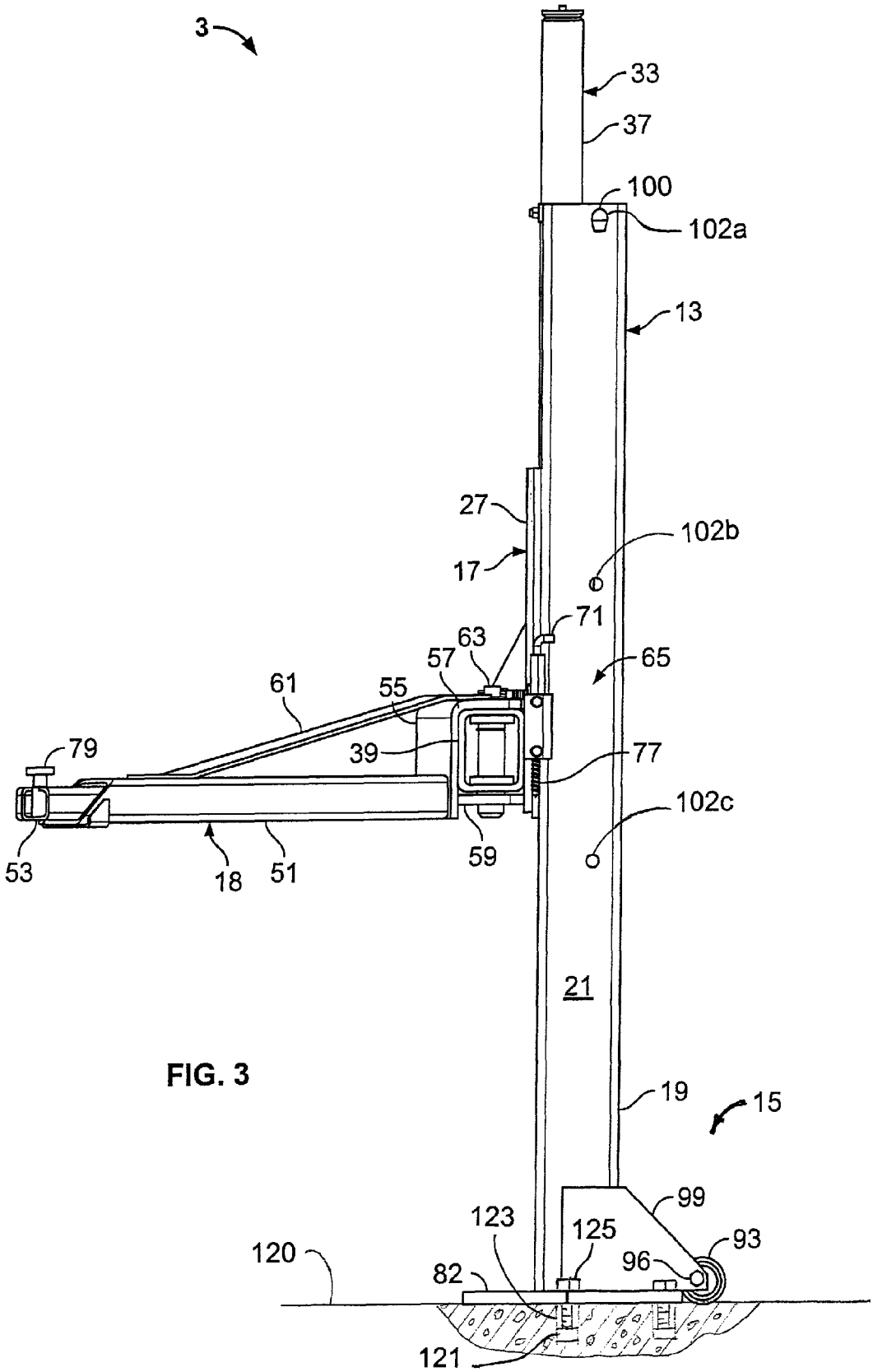
FIG. 3 is a side elevational view of the lifting column of FIG. 2.
Figure 4:
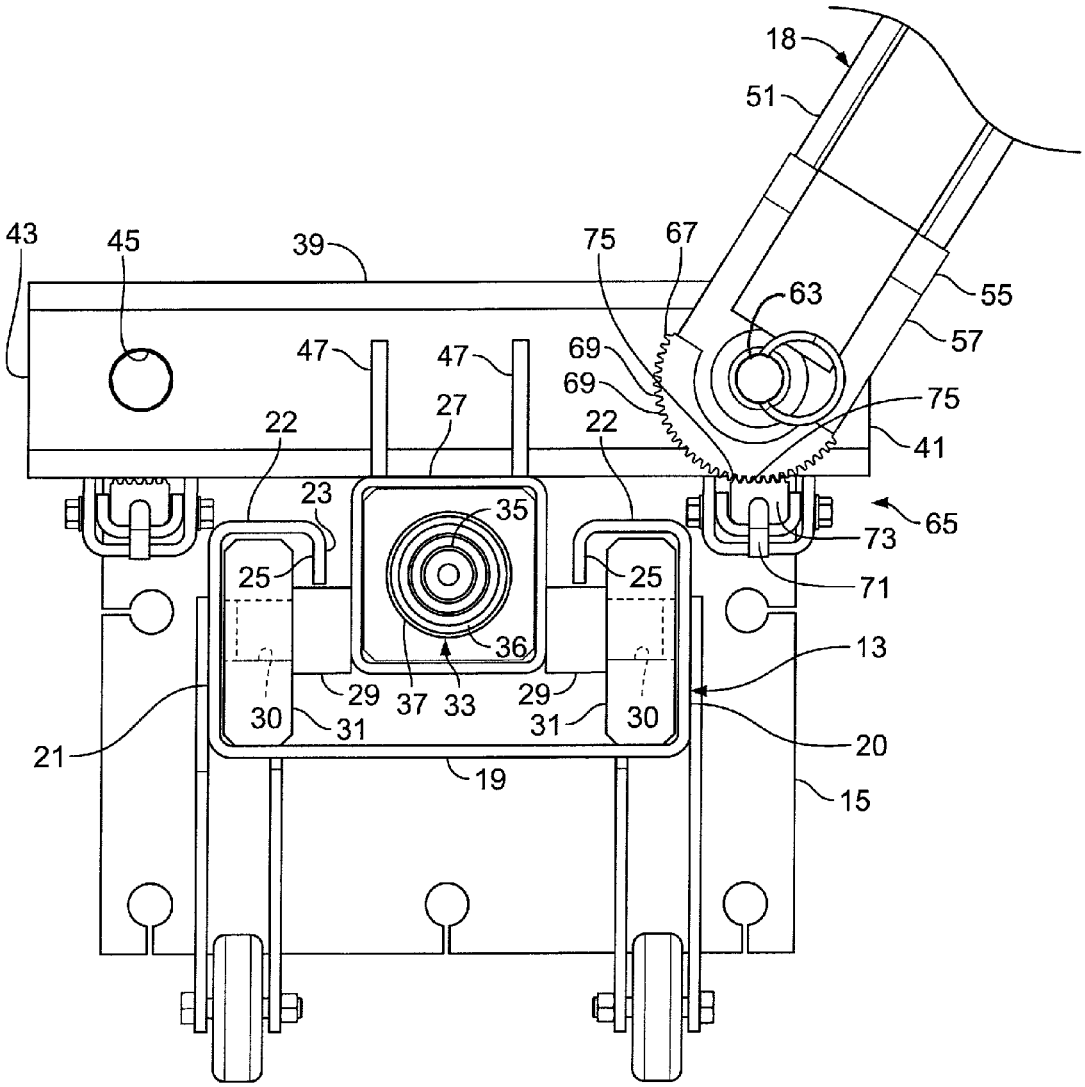
FIG. 4. is a fragmentary cross-sectional view of the lifting column taken generally along line 4-4 in FIG. 2 and showing one arm thereof removed for clarity.
Figure 5:
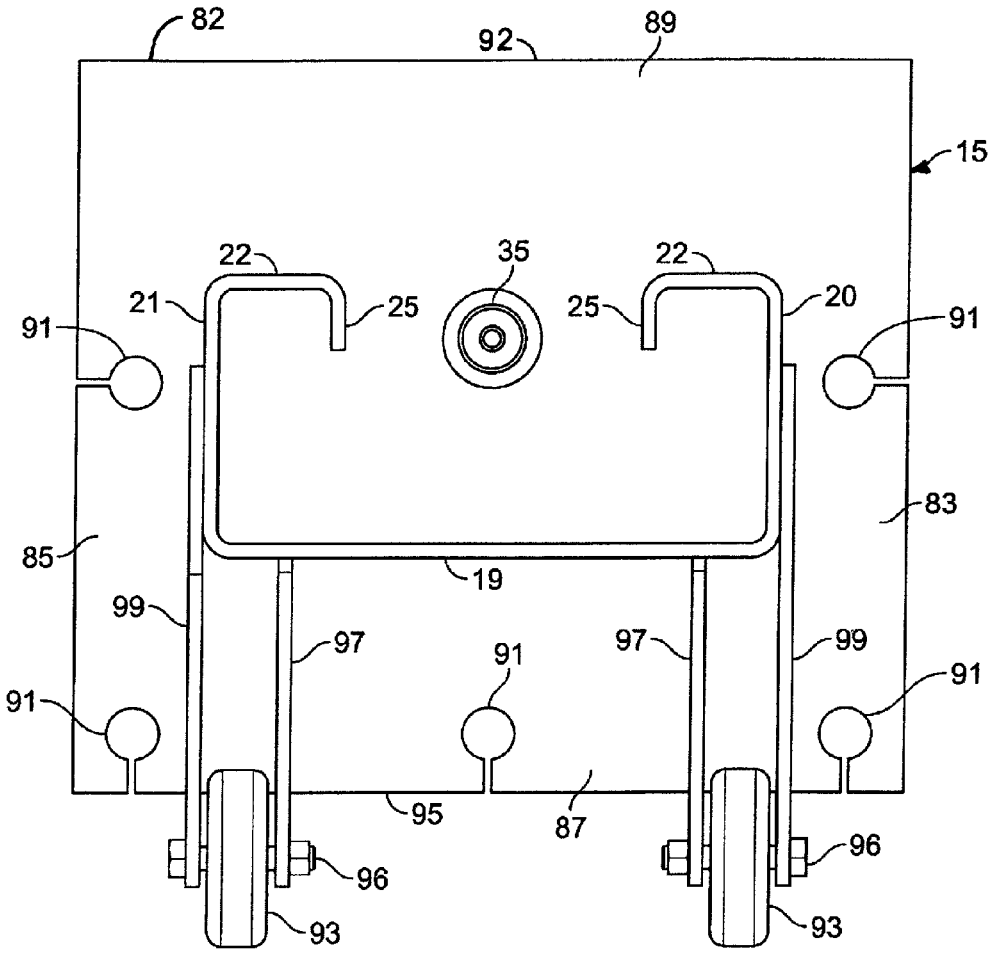
FIG. 5 is a cross-sectional view of the lifting column taken generally along line 5-5 in FIG. 2.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIG. 1, the reference number 1 generally designates a portable two post lift according to the present invention. The lift 1 generally includes two portable lifting columns 3, a power unit 5 and flow divider 7 mounted on a cart 9, and a pair of quick disconnect hoses 11. Each lifting column 3 includes a post 13 extending upwardly from a column base 15, and a lifting carriage 17 vertically moveable along the post 13. Mounted on each lifting carriage 17 and extending outwardly therefrom are a pair of arms 18 for engaging an undercarriage of a vehicle (not shown). The column bases 15 are adapted to be bolted to a ground surface, such as a concrete slab, when the lift 1 is in use, and to be unbolted from the ground surface when the lift is not in use so that the lifting columns 3 can be moved to storage.

Referring to FIGS. 2-5, the post 13 of each lifting column 3 is generally rectangular in cross section and includes a rear wall 19, and first and second side walls 20 and 21, respectively. The front of the post 13 includes a pair of narrow front flanges 22 which extend inwardly from the respective side wall 20 or 21 and define a slot 23 between them. A respective edge flange 25 (see FIGS. 4 and 5) extends rearwardly from each of the front flanges 22 adjacent the slot 23.

The lifting carriage 17 of each lifting column 3 includes a carriage base 27, which generally comprises a vertical length of square tubing having a width sized to allow the carriage base 27 to extend through the slot 23 and into the post 13. Two pairs of stub axles 29 (see FIG. 4) extend outwardly from the carriage base 27 in opposed lateral directions. Each stub axle 29 is received in a an opening 30 formed in a respective glide block 31. The glide blocks 31 are slidably received in the post 13 and are each captured front-to-rear between the rear wall 19 and a respective one of the front flanges 22. The glide blocks 31 are each also captured side-to-side between one of the side walls 20 or 21 and the respective edge flange 25. The carriage base 27 is vertically slidably moveable on the glide blocks 31 along the post 13.

Each lifting column 3 includes a respective hydraulic actuator 33 having a rod 35 connected to a piston 36 slidably received in a cylinder 37. A distal end of the rod 35 is connected to the column base 15 inside the post 13. The cylinder 37 is received inside and connected to the carriage base 27. Hydraulic pressure selectively acting on the piston will thus move the cylinder 37 and carriage base 27 upwardly relative to the column bases 15. Controlled release of pressure allows the carriage base 27 to move downwardly toward the column base 15.

The lifting carriage 17 further includes a crossbar 39 which comprises a length of square tubing secured to the front face of the carriage base 27 proximate a lower end thereof. The crossbar 39 is positioned transverse to the carriage base 27 outside the post 13 and includes opposed crossbar ends 41 and 43, spaced outwardly from the side walls 20 and 21 of the post 13, respectively. The crossbar 39 further includes a pair of vertical pin receivers 45 (see FIG. 4 in which one of the arms 18 has been removed), one proximate each of the crossbar ends 41 and 43. Gussets 47 are welded between the top face of the crossbar 39 and the front face of the carriage base 27 to reinforce the connection therebetween.

The arms 18 are mounted on the crossbar 39 by way of the pin receivers 45. Each arm 18 includes a proximate arm section 51 and a distal arm section 53 telescopically engaged with the respective proximate section 51. Both the proximate arm sections 51 and the distal arm sections 53 are shown as being formed of rectangular tubing, with the distal arm sections 53 being smaller in cross section and slidably received within the proximate arm sections 51. The proximate end of each proximate arm section 51 has a clevis 55 formed thereon for connection to the crossbar 39. Each clevis 55 includes an upper clevis plate 57 and a lower clevis plate 59. Each upper clevis plate 57 is spaced upwardly from the upper face of the respective proximate arm section 51, and a respective cross brace 61 extends between each upper clevis plate 57 and the upper face of the respective proximate arm section 51. A respective clevis pin 63 is simultaneously received through respective openings in the upper and lower clevis plates 57 and 59 of each clevis 55 and the respective pin receiver 45 to attach the arms 18 to the crossbar 39. The arms 18 may be easily removed for storage of the lift 1 by removing the clevis pins 63 and disconnecting the arms 18 from the crossbar 39.

The arms 48 are angularly adjustable relative to the crossbar 39 by rotation about the clevis pins 63. Arm restraints 65 are provided for selectively retaining each arm in a selected angular position. Each arm restraint 65 includes an arcuate rack member 67 mounted on a respective one of the proximate arm sections 51 concentric with the respective pin receiver 45. Each rack member 67 has teeth 69 formed on the outer edge thereof. Slidable latch bolts 71 are mounted on the crossbar 39 and include toothed latching members 73 having teeth 75 engageable with the teeth 69 of the rack members 67. The latch bolts 71 are vertically moveable between a lowered, latched position wherein the teeth 75 engage the teeth 69 and prevent the arms 48 from rotating about the clevis pins 63 and a raised, unlatched position wherein the arms 48 are freely rotatable about the clevis pins 63. Compression springs 77 bias the latch bolts 71 into the latched position. The latch bolts 71 extend downwardly a sufficient distance that, when the respective lifting carriage 17 is in its fully lowered position, the lower ends of the latch bolts 17 engage the column base 15, thereby compressing the springs 77 and releasing the latching members 73 from the rack members 67. This allows the arms 18 to be freely adjustable when the lifting carriages 17 are in their lowered positions.

Means for engaging the undercarriage of a vehicle (not shown), such as lifting pads 79 rotatably received in pad receivers 81, are provided on the distal arm sections 53 proximate the distal ends thereof.

Each column base 15 includes a base plate 82 having outer edges spaced outwardly from the side walls 20 and 21, rear wall 19 and front flanges 22 of the post 13, respectively, to form a first side mounting flange 83, a second side mounting flange 85, a rear mounting flange 87 and a front mounting flange 89. For purposes of this description, the rear mounting flange 87 will be considered to be the entire portion of the base plate 82 lying rearward of the rear wall 19 and the front mounting flange 89 will be considered to be the entire portion of the base plate 82 lying forward of the front flanges 22, with the side mounting flanges 83 and 85 lying threrebetween and laterally outward from the respective sidewalls 20 and 21. It is to be understood, however, that the portions of the base plate 82 lying rearward of the rear wall 19 and forward of the front flanges 22 yet laterally outward from the side walls 20 and 21 could also be considered part of the side mounting flanges 83 and 85, respectively.

A plurality of anchor bolt receiving holes 91 are formed through the mounting flanges 83-89. As a vehicle is lifted by the respective lifting column 3, the weight of the vehicle is supported on the arms 18 forward of the column base 15, creating a load torque on the base plate 82 which acts to urge the base plate 82 upwardly at the rear mounting flange 87 and pivot about a front edge 92 of the front mounting flange 89. It is therefore preferred that the anchor bolt receiving holes 91 be concentrated along the rear mounting flange 87 and side mounting flanges 83 and 85 to resist this load torque. The base plate 82 is thus shown as having three anchor bolt receiving holes 91 along the rear mounting flange 87 with one additional bolt receiving hole 91 through each of the side flanges 83 and 85. No anchor bolt receiving holes 91 are shown through the front mounting flange 89 since bolts in this location would be of limited utility in resisting the load torque due to the short lever arms that would exist between such holes 91 and the front edge 92.

The anchor bolt receiving holes 91 are each shown as including a respective slot which extends between the anchor bolt receiving hole 91 and the nearest edge of the base plate 82. These slots are the result of flame-cutting the holes 91 and do not serve any function.

Each column base 15 further includes a pair of wheels 93 mounted rearwardly of a rear edge 95 of the base plate 82. Each wheel 93 rotates about a respective axle 96 and is captured between an inner wheel plate 97, which is fixed to and extends rearwardly from the rear wall 19 of the post 13, and an outer wheel plate 99 which is fixed to and extends rearwardly from the respective side wall 20 or 21 of the post 13. Each of the wheel plates 97 and 99 is further fixed to the upper face of the base plate 82 such that the plates 97 and 99 further act as gussets to reinforce the connection between the column base 15 and the post 13.

The wheels 93 are positioned to rollingly engage a ground surface when the bottom surface of the of the base plate 82 is in abutment against the ground surface. Further, since the wheels are positioned rearwardly of the base plate 82, the respective lifting column 3 can be tilted rearwardly on the wheels 93 to bring the respective base plate 82 off of the ground surface, allowing the lifting column 3 to be rolled across the ground surface on the wheels 93.

Each lifting column 3 is provided with a handle 100 positionable near the top of the respective post 13 to facilitate tilting and rolling the lifting column 13. Each handle 100 generally comprises a bar 101 extending through aligned openings 102*a* in the side walls 20 and 21 near the top of the respective post 13. One end of the handle 100 is provided with a grip 103. When the lift 1 is in use, the handles 100 also serve as safety lock bars to prevent inadvertent lowering of the lifting carriages 17. In order to prevent the lifting carriages from being lowered or falling from their fully raised positions, the handles 100 may each be inserted with the respective bar 101 extending through openings 102*b* in the side walls 20 and 21, which are positioned immediately below the lifting carriages 17 when the lifting carriages 17 are in their fully raised position. Similarly, if the carriages 17 are only partly raised, the handles 100 may each be inserted with the respective bar 101 extending through openings 102*c* in the side walls 20 and 21, which are positioned immediately below the lifting carriages 17 when the lifting carriages 17 are approximately midway between their raised and lowered positions.

Hydraulic power for the lifting columns 3 is provided by the power unit 5, which is mounted on the cart 9. The power unit 5 includes a motor 105, such as an AC electric motor, which drives a hydraulic pump 107 which circulates hydraulic fluid from a reservoir 109. From the pump 107, fluid flows to the flow divider 7 which directs flow to the two lifting columns 3. The flow divider 7 is preferably a rotary gear flow divider adapted to provide synchronized movement of the two lifting columns 3 even if uneven weight acting on the lifting columns 3 results in unequally loaded hydraulic actuators 33. The cart 9 further includes wheels 111 and grips 113 for easy portability of the cart 9.

The flow divider 7 includes first and second quick disconnect fittings 115 and 117 each of which receives a first end of a respective one of the quick disconnect hoses 11. The second end of each hose 11 is connected to a respective quick disconnect fitting 119 located on the post 13 of a respective one of the lifting columns 3. The fittings 119 on the posts 13 are each connected to the cylinder 37 of the actuator 33 positioned inside the respective post 13.

In use, the lift 1 can be quickly and easily moved from storage to a working position. On initial installation of the lift 1, the lifting columns 3 (without the arms 18) are rolled into their desired positions on a concrete slab 120 using the wheels 93. Using a hammer drill or the like, holes 121 are drilled in the slab 120 in alignment with the anchor bolt receiving holes 91 in the column bases 15, and internally-threaded recessed anchors 123 are installed in the holes. Anchor bolts 125 are then installed through the anchor bolt receiving holes 91 and tightened into the anchors. As the anchor bolts 125 are tightened, the anchors 123 expand against the sides of the holes 121 and grip the concrete. The arms 18 are then installed on the crossbars 39 using the clevis pins 63. The power unit 5 mounted on the cart 9 is then rolled into position and connected to the lifting columns 3 using the quick disconnect hoses 11. The power unit 5 is then plugged in and the lift 1 is ready for use.

The lift 1 is easily removed from the work area for storage by disconnecting the power unit 5, removing the arms 18, and removing the anchor bolts attaching the lifting columns 3 to the slab. The cart 9 and lifting columns 3 can then be rolled to a storage location on there associated wheels 93 and 111. Because of the relatively small size of the column bases 15, minimal storage space is required. It should be noted that the anchors remain installed in the concrete slab, so that on the second and succeeding installation of the lift 1, no drilling is required. The lifting columns 3 are simply positioned over the existing holes in the slab, and the anchor bolts installed.

As disclosed herein, the lift 1 is well adapted as a medium rise lift having a lifting height of approximately 45 inches and a column height that increases from a minimum of 64 inches to a maximum of 89 inches as the carriages 17 and associated actuator cylinders 37 are raised. As such, the lift 1 is ideally suited for use in a residential garage or the like having a ceiling height as low as eight feet (96 inches).

It is to be understood that while certain forms of the present invention have been illustrated and described herein, it is not to be limited to the specific forms or arrangement of parts described and shown. For example, it is to be understood that although the base plate 82 of the column base 15 is shown and described herein as being generally square, it is to be understood that the plate 82 could be of virtually any geometric shape, including other polygonal shapes as well as circular, ovoid or elliptical shapes.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A portable automobile lift comprising:

a) a pair of unconnected lifting columns, each said lifting column including a column base, a post extending upwardly from said column base, a lifting carriage moveably mounted on a forward inward side of said post, and a hydraulic actuator connected to said lifting carriage for movement of said lifting carriage along said post, said lifting carriage having at least one arm extending outwardly therefrom having a length sufficient to engage an undercarriage of a vehicle positioned between said inward sides of said lifting columns; and b) a power unit selectively supplying hydraulic pressure to said linear actuators and a flow divider for dividing flow from said power unit between said hydraulic actuator on each of said plurality of lifting columns; wherein c) each said column base comprises a respective base plate connected to a lower end of the respective post and having at least one edge spaced outwardly from a respective side of said post to form a mounting flange, said mounting flange having at least one anchor bolt receiving hole extending therethrough, each said column base further including a pair of wheels positioned to engage a ground surface rearward of said base plate.

2. The portable automobile lift as in claim 1 wherein each said base plate includes a front edge, a rear edge, a first side edge and a second side edge, wherein each said rear edge is said at least one edge and is spaced outwardly from a rear wall of the respective post to form said first mounting flange.

3. The portable automobile lift as in claim 2 wherein there are a plurality of said anchor bolt holes extending through said first mounting flange of each said base plate.

4. The portable automobile lift as in claim 3, wherein:

a) said first side edge of each said base plate is spaced outwardly from a first side wall of the respective post to form a second mounting flange;

b) said second side edge of each said base plate is spaced outwardly from a second side wall of the respective post to form a third mounting flange; and c) said second and third mounting flanges each have at least one anchor bolt receiving hole extending therethrough.

5. The portable automobile lift as in claim 4 wherein said front edge of each said base plate is spaced outwardly from a front wall of the respective post to form a fourth mounting flange.

6. The portable automobile lift as in claim 5 wherein there are no anchor bolt receiving holes in said fourth mounting flanges.

7. The portable automobile lift as in claim 1 wherein no legs extend outwardly from any one of said column bases.

8. The portable automobile lift as in claim 1 wherein each of said wheels is captured between respective inner and outer wheel plates extending rearwardly from the respective post.

9. The portable automobile lift as in claim 8 wherein said outer wheel plates are connected to respective side walls of the respective post and said inner wheel plates are connected to a rear wall of the respective post.

10. The portable automobile lift as in claim 8 wherein lower edges of said wheel plates engage an upper surface of said base plate to reinforce the connection between the respective post and the respective base plate.

11. The portable automobile lift as in claim 1 wherein said power unit is mounted on a cart for portability.

12. The portable automobile lift as in claim 11 wherein said power unit includes an AC electric motor driving a hydraulic pump and a reservoir for hydraulic fluid.

13. The portable automobile lift as in claim 1 wherein said flow divider is a rotary gear flow divider.

14. The portable automobile lift as in claim 1 in combination with:

a) a concrete slab, said concrete slab having a plurality of holes bored therein, each of said holes in said slab having a respective internally threaded anchor received therein; and b) at least one anchor bolt inserted through a respective one of said at least one anchor bolt receiving holes in said mounting flange of each said lifting column, each said at least one anchor bolt being threadably received in a respective one of said anchors.

15. A portable automobile lift comprising:

a) a pair of lifting columns, each said lifting column including a column base, a post extending upwardly from said base, a lifting carriage moveably mounted on said post, and a hydraulic actuator connected to said lifting carriage for movement of said lifting carriage along said post; said lifting carriage having a pair of telescoping arms pivotally connected to said lifting carriage and extending outwardly therefrom and being adjustable to a length sufficient to engage an undercarriage of a vehicle positioned between inward sides of said pair of lifting columns;

b) each said column base comprising a respective base plate connected to a lower end of the respective post and having at least one edge spaced outwardly from a respective side of said post to form a mounting flange, said mounting flange having at least one anchor bolt receiving hole extending therethrough;

c) a pair of wheels mounted to said column base of each said lifting column and positioned to engage a ground surface when said lifting column is tilted over said pair of wheels;

d) a portable power unit selectively supplying hydraulic fluid under pressure to said hydraulic actuator of each of said lifting columns through a hydraulic hose connected between each said hydraulic actuator and said power unit; and e) a flow divider dividing the flow of hydraulic fluid from said power unit to said hydraulic actuator of each of said lifting columns through said respective hydraulic hose; said flow divider providing synchronized movement of each of said lifting carriages of said pair of lifting columns in the presence of uneven loads thereon.

16. The portable automobile lift as in claim 15 wherein each of said hydraulic hoses is connected to said respective hydraulic actuator by a quick connect coupler.

17. The portable automobile lift as in claim 15 wherein said flow divider is a rotary gear flow divider.

18. The portable automobile lift as in claim 15 wherein said base plate includes a front edge, a rear edge, a first side edge and a second side edge, wherein said rear edge is said at least one edge and is spaced outwardly from a rear wall of said post to form said first mounting flange and a plurality of said anchor bolt holes extend through said first mounting flange; and each of said wheels is mounted on an axle supported by a wheel plate connected to said post and said base plate, reinforcing the connection between said post and said base plate and supporting said wheel rearward of said first mounting flange.

19. The portable automobile lift as in claim 15 wherein each said lifting column further comprising at least one pair of aligned lock bar securement holes formed through said opposed sidewalls of said post; a lock bar insertable through said at least one pair of aligned pair of lock bar securement holes for preventing said carriage from dropping therebelow, said lift further comprising a pair of aligned lock bar storage holes extending through said sidewalls of said post proximate an upper end thereof; said lock bar having a length which is long enough that a portion of each end of said lock bar sized to be gripped by a user's hand extends past said opposed sidewalls of said post when said lock bar is positioned through said pair of aligned lock bar storage holes and said pair of aligned lock bar storage holes is positioned at a height to facilitate grasping of said lock bar when positioned therein for tilting said lift onto said wheels and for maneuvering said lift on said wheels.

20. The lift as in claim 19 wherein said lock bar has a grip on one end thereof.

21. The lift as in claim 15 wherein said lift is a medium rise lift having a lifting height of approximately forty-five inches and each of said pair of lifting columns has a maximum height of eighty nine inches.

22. The lift as in claim 15 wherein said lift is a medium rise lift wherein a maximum height of each of said lifting columns is under ninety-six inches.

23. A portable automobile lift comprising a pair of lifting columns, each lifting column comprising:

a column base;

a post extending upwardly from said base; said post comprising a rear wall, opposed side walls and a pair of front flanges extending inward from a respective one of said opposed side walls and defining a slot therebetween spaced forward of said rear wall;

a lifting carriage having a carriage base extending through said slot between said pair of front flanges; said base having a pair of telescoping arms pivotally connected to and extending outward from said base and being adjustable to a length sufficient to engage an undercarriage of a vehicle positioned adjacent said lifting column, said base having a stub axle extending outward from each of said opposed sides of said base between said rear wall and said front flanges; said lifting carriage further comprising a glide block mounted on each stub axle and captured between said rear wall and a respective one of said front flanges; said carriage base vertically slidable on said glide blocks relative to said post;

a hydraulic actuator connected to said lifting carriage for moving said lifting carriage relative to said post;

said base connected to a lower end of said post and having a front edge, a rear edge, a first side edge and a second side edge, said rear edge spaced rearward from said rear wall of said post and said first and second side edges spaced outward from said opposed sidewalls of said post to form a mounting flange, said mounting flange having a plurality of anchor bolt receiving holes extending therethrough; and a pair of wheels, each said wheel mounted on an axle supported by a wheel plate connected to said post and said base plate, reinforcing the connection between said post and said base plate and supporting said wheel rearward of said rearward edge of said base and positioned to engage a ground surface when said lifting column is tilted over said pair of wheels; and said portable automobile lift further comprising:

a portable power unit selectively supplying hydraulic fluid under pressure to said hydraulic actuator of each of said lifting columns through a hydraulic hose connected between each said hydraulic actuator and said power unit; and a flow divider dividing the flow of hydraulic fluid from said power unit to said hydraulic actuator of each of said lifting columns through said respective hydraulic hose;

said flow divider providing synchronized movement of each of said lifting carriages of said pair of lifting columns in the presence of uneven loads thereon.

24. The portable automobile lift as in claim 23 wherein said flow divider is a rotary gear flow divider.

25. The portable automobile lift as in claim 23 wherein each said lifting column further comprising at least one pair of aligned lock bar securement holes formed through said opposed sidewalls of said post; a lock bar insertable through said at least one pair of aligned pair of lock bar securement holes for preventing said carriage from dropping therebelow, said lift further comprising a pair of aligned lock bar storage holes extending through said sidewalls of said post proximate an upper end thereof; said lock bar having a length which is long enough that a portion of each end of said lock bar sized to be gripped by a user's hand extends past said opposed sidewalls of said post when said lock bar is positioned through said pair of aligned lock bar storage holes and said pair of aligned lock bar storage holes is positioned at a height to facilitate grasping of said lock bar when positioned therein for tilting said lift onto said wheels and for maneuvering said lift on said wheels.

26. The lift as in claim 25 wherein said lock bar has a grip on one end thereof.

27. The lift as in claim 23 wherein said lift is a medium rise lift having a lifting height of approximately forty-five inches and each of said pair of lifting columns has a maximum height of eighty nine inches.

28. The lift as in claim 23 wherein said lift is a medium rise lift wherein a maximum height of each of said lifting columns is under ninety-six inches.

* * * * *